US006814674B2

(12) United States Patent
Clausen et al.

(10) Patent No.: US 6,814,674 B2
(45) **Date of Patent: *Nov. 9, 2004**

(54) IRON GOLF CLUB

(75) Inventors: Karl A. Clausen, San Marcos, CA (US); Robert R. Lang, Escondido, CA (US); Augustin W. Rollinsoin, Carlsbad, CA (US); Richard C. Helmstetter, Rancho Santa Fe, CA (US)

(73) Assignee: Callaway Golf Company, Carlsbad, CA (US)

( * ) Notice: Subject to any disclaimer, the term of this patent is extended or adjusted under 35 U.S.C. 154(b) by 182 days.

This patent is subject to a terminal disclaimer.

(21) Appl. No.: 10/065,233

(22) Filed: Sep. 26, 2002

(65) Prior Publication Data

US 2004/0058745 A1 Mar. 25, 2004

Related U.S. Application Data

(63) Continuation-in-part of application No. 10/065,147, filed on Sep. 20, 2002.

(51) Int. Cl.[7] ..... A63B 53/04
(52) U.S. Cl. ..... 473/342; 473/349; 473/350
(58) Field of Search ..... 473/324, 349, 473/350, 347, 348, 290, 291, 342, 305

(56) References Cited

U.S. PATENT DOCUMENTS

| | | | | |
|---|---|---|---|---|
| 3,961,796 | A | | 6/1976 | Thompson |
| 4,521,022 | A | | 6/1985 | Schmidt |
| 4,534,558 | A | | 8/1985 | Yoneyhama |
| 4,630,827 | A | | 12/1986 | Yoneyhama |
| 4,635,941 | A | | 1/1987 | Yoneyhama |
| 4,645,207 | A | | 2/1987 | Teramoto et al. |
| 4,653,756 | A | | 3/1987 | Sato |
| 4,664,383 | A | | 5/1987 | Aizawa |
| 4,667,963 | A | | 5/1987 | Yoneyhama |
| 4,671,513 | A | * | 6/1987 | Swanson ..... 473/328 |
| 4,687,205 | A | | 8/1987 | Tominaga et al. |
| 4,690,408 | A | | 9/1987 | Kobayashi |
| 4,697,814 | A | | 10/1987 | Yamada |
| 4,699,383 | A | | 10/1987 | Kobayashi |
| 4,708,347 | A | | 11/1987 | Kobayashi |
| 4,728,105 | A | | 3/1988 | Kobayashi |
| 4,754,971 | A | | 7/1988 | Kobayashi |
| 4,754,975 | A | | 7/1988 | Aizawa |
| 4,792,140 | A | | 12/1988 | Yamaguchi et al. |
| 4,798,383 | A | | 1/1989 | Nagasaki et al. |
| 4,798,384 | A | | 1/1989 | Kobayashi |
| 4,809,978 | A | | 3/1989 | Yamaguchi et al. |
| 4,824,110 | A | | 4/1989 | Kobayashi |
| 4,836,550 | A | | 6/1989 | Kobayashi |
| 4,852,880 | A | | 8/1989 | Kobayashi |
| 4,874,171 | A | | 10/1989 | Ezaki et al. |
| 4,884,812 | A | | 12/1989 | Nagasaki et al. |
| 4,964,640 | A | | 10/1990 | Nakanishi et al. |
| 4,986,541 | A | | 1/1991 | Teramoto et al. |
| 4,995,609 | A | | 2/1991 | Parente et al. |
| 5,004,242 | A | | 4/1991 | Iwanaga et al. |
| 5,009,425 | A | | 4/1991 | Okumoto et al. |
| 5,016,882 | A | | 5/1991 | Fujimura et al. |
| 5,016,883 | A | | 5/1991 | Kobayashi |

(List continued on next page.)

*Primary Examiner*—Sebastiano Passaniti
(74) *Attorney, Agent, or Firm*—Michael A. Catania; Elaine H. Lo

(57) ABSTRACT

The iron golf club head (20) of the present invention is preferably composed of three main components: a periphery member (22), a central member (24) and a face plate 26. The periphery member (22) is preferably composed of a high density material such as a iron-nickel tungsten alloy. The central member (24) is preferably composed of a bulk molding compound. The face plate (26) is preferably composed of a titanium alloy material. The iron golf club head (20) preferably has high moments of inertia Izz and Ixx.

11 Claims, 10 Drawing Sheets

U.S. PATENT DOCUMENTS 5,078,397 A 1/1992 Aizawa
5,090,702 A 2/1992 Viste
5,121,918 A 6/1992 Teramoto et al.
5,176,384 A 1/1993 Sata et al.
5,184,823 A 2/1993 Desboilles et al.
5,190,290 A 3/1993 Take
5,228,694 A 7/1993 Okumoto et al.
5,282,625 A 2/1994 Schmidt et al.
5,344,150 A 9/1994 Schmidt et al.
5,346,213 A 9/1994 Yamada
5,348,302 A 9/1994 Sasamoto et al.
5,398,929 A 3/1995 Kitaichi
5,409,229 A 4/1995 Schmidt et al.
5,411,264 A 5/1995 Oku
5,413,336 A 5/1995 Iwanaga
5,447,311 A 9/1995 Viollaz et al.
5,465,968 A 11/1995 Aizawa et al.
5,472,201 A 12/1995 Aizawa et al.
5,499,819 A 3/1996 Nagamoto
5,544,885 A 8/1996 Besnard et al.
5,564,705 A 10/1996 Kobayashi
5,588,922 A 12/1996 Schmidt et al.
5,599,243 A 2/1997 Kobayashi
5,601,501 A 2/1997 Kobayashi
5,611,740 A 3/1997 Nagamoto
5,626,530 A 5/1997 Schmidt et al.
5,628,698 A 5/1997 Sumitomo
5,643,103 A 7/1997 Aizawa
5,658,208 A 8/1997 Shimasaki
5,704,849 A 1/1998 Schmidt et al.
5,735,755 A 4/1998 Kobayashi
5,749,794 A 5/1998 Kobayashi et al.
5,755,624 A 5/1998 Helmstetter
5,766,092 A 6/1998 Mimeur et al.
5,776,010 A 7/1998 Helmstetter et al.
5,792,004 A 8/1998 Nagamoto
5,792,005 A 8/1998 Sieleman et al.
5,807,191 A 9/1998 Nakahara
5,816,936 A 10/1998 Aizawa et al.
5,827,131 A 10/1998 Mahaffey et al.
5,833,551 A 11/1998 Vincent et al.
5,836,830 A 11/1998 Onuki et al.
5,885,166 A 3/1999 Shiraishi
5,890,971 A 4/1999 Shiraishi
5,899,820 A 5/1999 Minematsu et al.
5,921,869 A 7/1999 Blough et al.
5,971,868 A 10/1999 Kosmatka
6,001,032 A 12/1999 Onuki et al.
6,030,293 A 2/2000 Takeda
6,030,295 A 2/2000 Takeda
6,045,455 A 4/2000 Kosmatka et al.
6,077,171 A 6/2000 Yoneyhama
6,089,992 A 7/2000 Onuki et al.
6,093,112 A 7/2000 Peters et al.
6,117,023 A 9/2000 Onuki et al.
6,186,905 B1 2/2001 Kosmatka
6,200,228 B1 3/2001 Takeda
6,210,290 B1 4/2001 Erickson et al.
6,220,971 B1 4/2001 Takeda
6,238,301 B1 5/2001 Takeda
6,277,326 B1 8/2001 Vecchio et al.
6,309,309 B1 10/2001 Beach et al.
6,319,147 B1 11/2001 Nakamura et al.
6,406,382 B1 6/2002 Deshmukh et al.
6,440,009 B1 8/2002 Guibaud et al.
6,440,010 B1 8/2002 Deshmukh et al.
6,481,088 B1 11/2002 Inoue et al.
6,491,593 B2 12/2002 Takeda
6,497,629 B2 12/2002 Takeda
6,517,448 B1 2/2003 Takeda
6,592,468 B2 7/2003 Vincent et al.

* cited by examiner

IRON GOLF CLUB

CROSS REFERENCE TO RELATED APPLICATIONS

The Present Application is a Continuation-In-Part Application of co-pending U.S. patent application Ser. No. 10/065,147, filed on Sep. 20, 2002.

FEDERAL RESEARCH STATEMENT

Not Applicable

BACKGROUND OF INVENTION

1. Field of the Invention

The present invention relates to an iron golf club. More specifically, the present invention relates to a multiple material iron golf club.

2. Description of the Related Art

Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The use of iron club heads composed of different materials has allowed some prior art irons to achieve some of these desires.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383, 4,792,139 and 4,884,812, all to Nagasaki, et al., which disclose an iron club head composed of stainless steel with a fiber reinforced plastic back plate to allow for weight adjustment and ideal inertia moment adjustment.

Another example is U.S. Pat. No. 4,848,747 which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 which disclose an iron club head composed of stainless steel with a fiber reinforcement in a rear recess to provide a dampening means for shock and vibrations, a means for increasing the inertial moment, a means for adjusting the center of gravity and a means for reinforcing the back plate. Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

The prior art fails to disclose an iron golf club head that is composed of multiple materials, has a low center of gravity, reduced vibrations, and a greater moment of inertia.

SUMMARY OF INVENTION

The present invention provides an iron golf club head which has a low center of gravity, a high moment of inertia, reduced vibrations and a solid feel and appearance. The present invention is able to provide these features through use of a multiple material iron club head.

One aspect of the present invention is an iron golf club head composed of a periphery member, a central member and a face plate. The periphery member is composed of a metal material. The periphery member has a sole wall, a toe wall extended upward from the sole wall at a first end of the sole wall, a hosel extending upward from the sole wall at a second end of the sole wall, and a heel wall extending upward from the sole wall. The central member is composed of a non-metal material. The central member has a body portion with a forward surface, a sole surface, a top surface, a toe surface, a heel surface and a flange extending from the top surface at an intersection of the top surface and the forward surface. The central member has a rear cavity defined by the body portion. The face plate is composed of a metal material and is disposed over the forward surface of the central member. A top line of the face plate is in contact with the flange of the central member.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
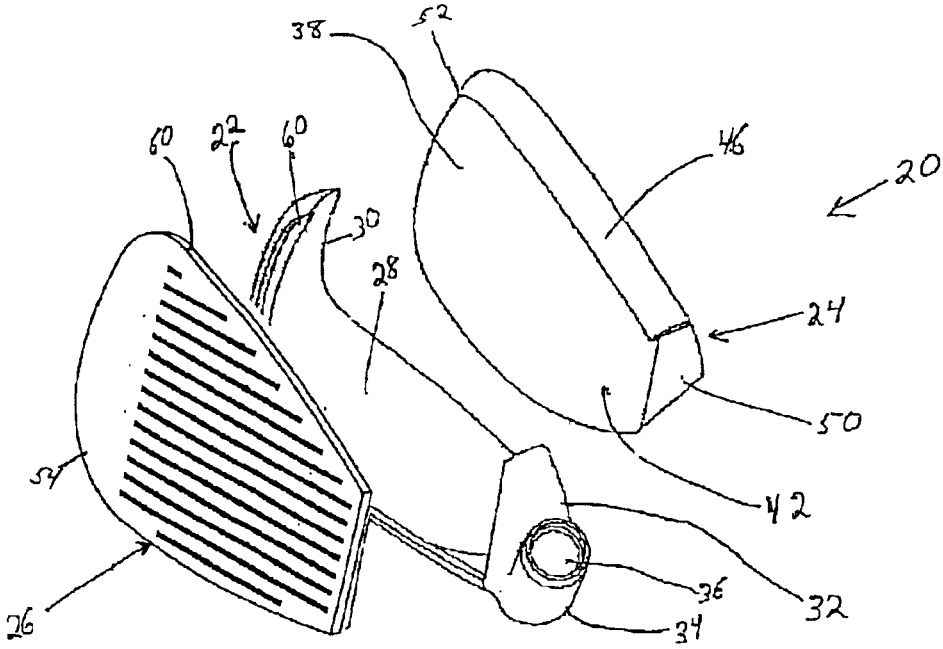
FIG. 1 is an exploded view of an iron club head of the present invention.
Figure 2:
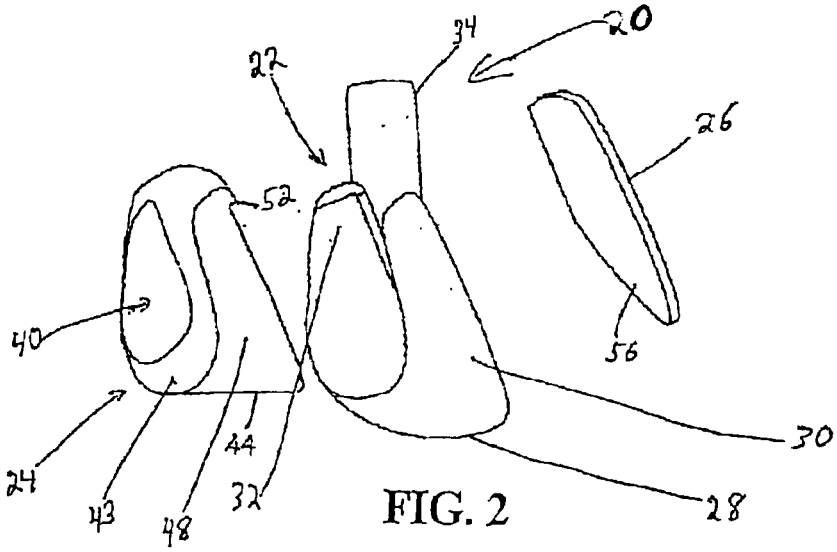
FIG. 2 is a side exploded view of an iron club head of the present invention.
Figure 3:
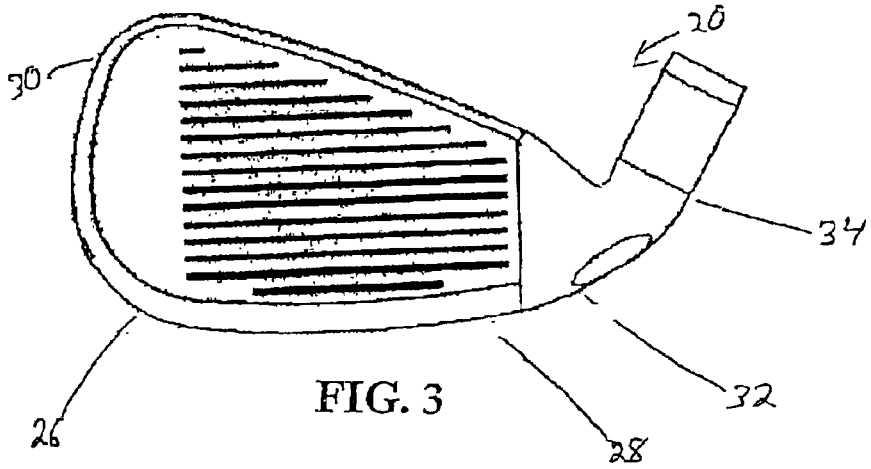
FIG. 3 is a front plan view of the an iron club head of the present invention.
Figure 4:
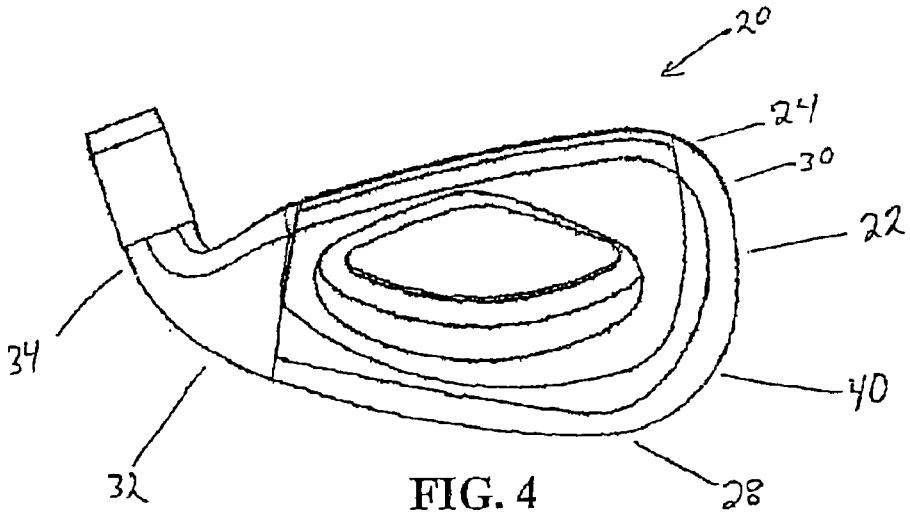
FIG. 4 is a rear plan view of the iron club head of FIG. 1.

As shown in FIGS. 1–8, an iron golf club head of the present invention is generally designated 20. The club head 20 is preferably composed of three main components: a periphery member 22, a central member 24 and a face plate 26. The club head 20 can range from a 1-iron to a lob-wedge, with the loft angle preferably ranging from fifteen degrees to sixty degrees. The three main components are assembled into the club head 20 using a process such as disclosed in co-pending U.S. patent application Ser. No. 10/065,150, filed on Sep. 20, 2002, entitled Method For Manufacturing Iron Golf Club Head, which is hereby incorporated in its entirety by reference.

The periphery member 22 is preferably composed of a material having a density greater than 7.86 grams per centimeter cubed ($g/cm^3$). A preferred material is an iron-nickel-tungsten alloy having a density preferably ranging from 8.0 $g/cm^3$ to 12.0 $g/cm^3$, more preferably ranging from 9.5 $g/cm^3$ to 11.0 $g/cm^3$, and most preferably 10.0 $g/cm^3$. An alternative material is a stainless steel material. Those skilled in the pertinent art will recognize that other materials may be used for the periphery member 22 without departing from the scope and spirit of the present invention.

The periphery member 22 has sole wall 28, a toe wall 30 extending upward from a toe end of the sole wall 28, a heel wall 32 extending upward from the sole wall 28 near a heel end of the sole wall 28, and a hosel 34 extending outward from the sole wall 28 at the heel end of the sole wall 28. The hosel 34 is preferably offset. The hosel 34 has a bore 36 for receiving a shaft, and the upper end of the hosel 34 preferably lies below an upper end of the toe wall 30 when the club head 20 is in the address position for striking a golf ball, not shown. The bore 36 preferably extends through the entire hosel 34 providing a short straight hollow hosel such as disclosed in U.S. Pat. No. 4,995,609, which pertinent parts are hereby incorporated by reference.

Figure 8:
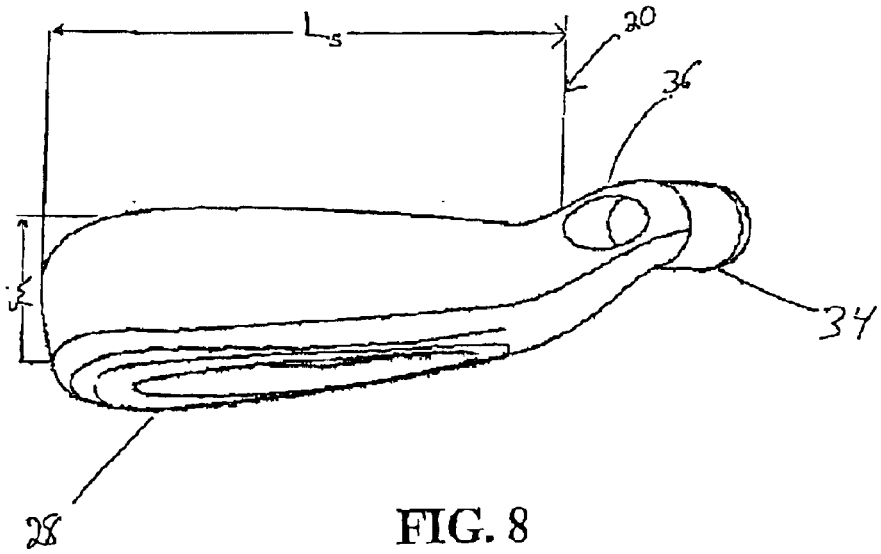
FIG. 8 is a bottom plan view of the iron club head of FIG. 1.
Figure 9:
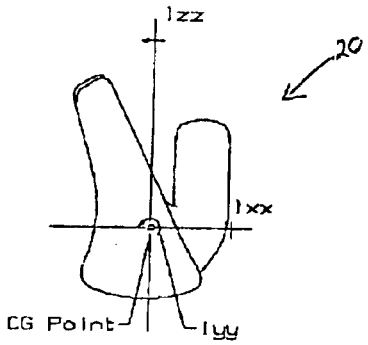
FIG. 9 is a toe side view of a golf club head of the present invention illustrating the moments of inertia through the center of gravity.
Figure 10:
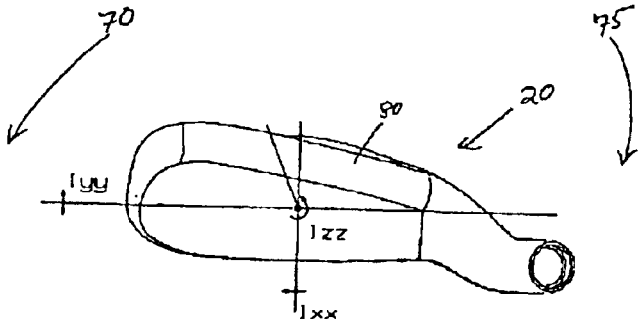
FIG. 10 is a top plan view of a golf club head of the present invention illustrating the moments of inertia through the center of gravity.
Figure 11:
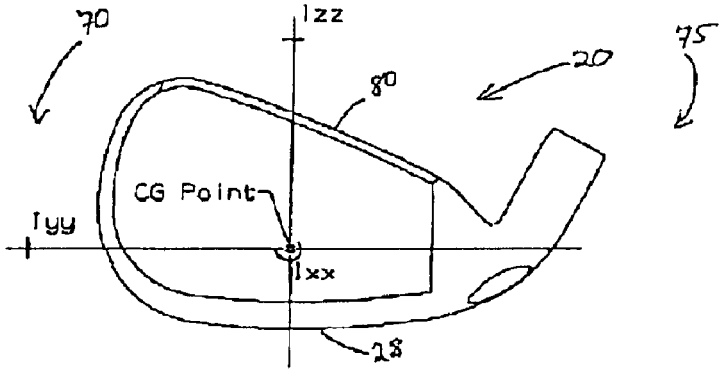
FIG. 11 is a front plan view of a golf club head of the present invention illustrating the moments of inertia through the center of gravity.
Figure 12:
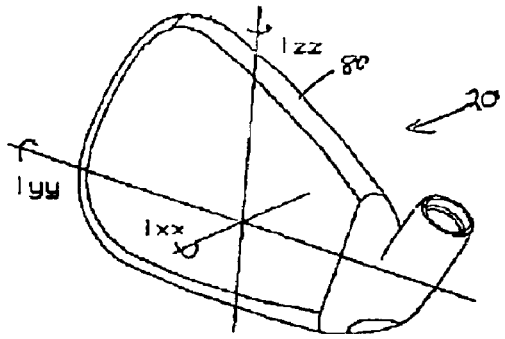
FIG. 12 is a front perspective view of a golf club head of the present invention illustrating the moments of inertia through the center of gravity.
Figure 13:
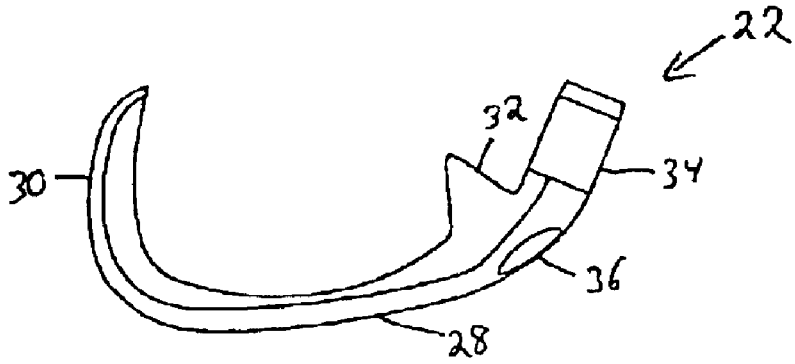
FIG. 13 is an isolated front view of a periphery member of a golf club head of the present invention.
Figure 14:
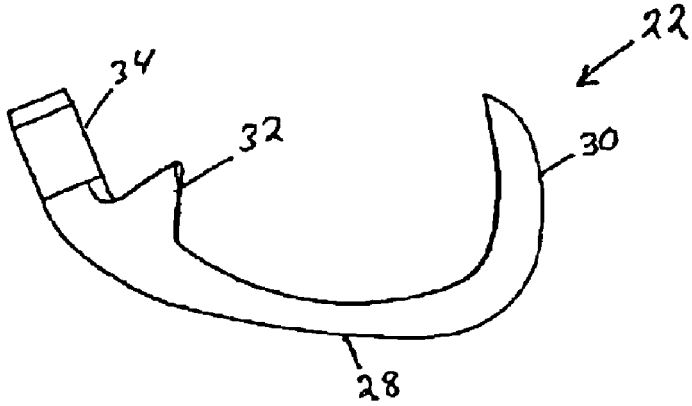
FIG. 14 is an isolated rear view of the periphery member of FIG. 13.
Figure 15:
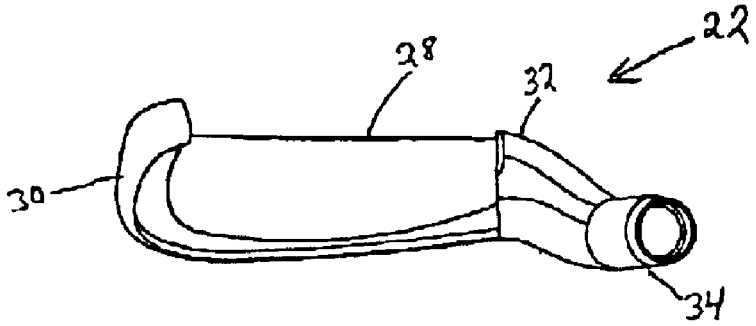
FIG. 15 is an isolated top view of the periphery member of FIG. 13.
Figure 16:
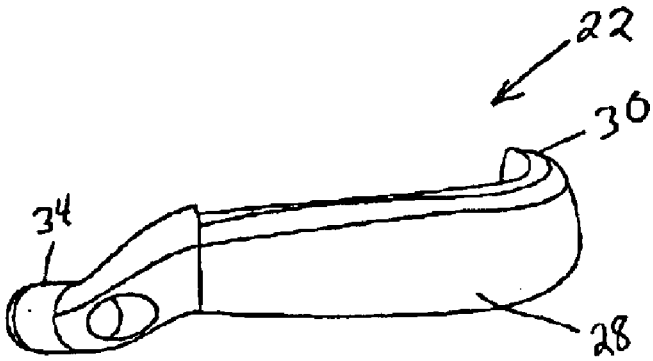
FIG. 16 is an isolated bottom view of the periphery member of FIG. 13.
Figure 17:
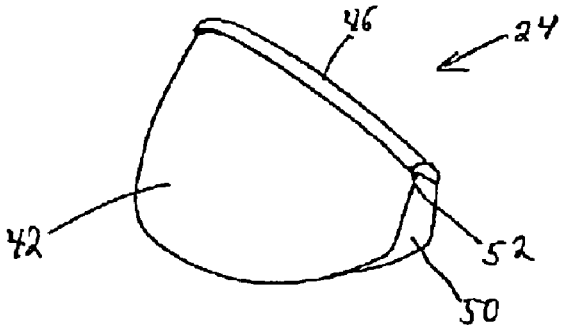
FIG. 17 is an isolated front perspective view of a central member of a golf club head of the present invention.
Figure 18:
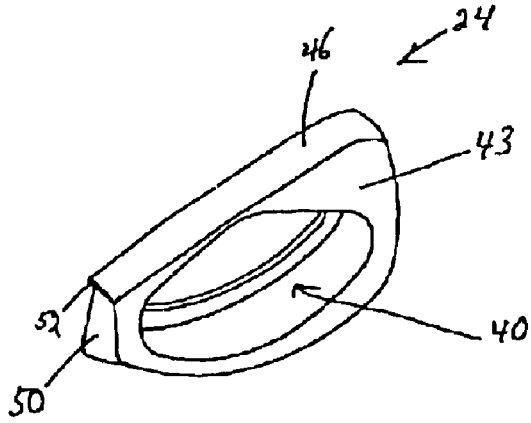
FIG. 18 is an isolated rear perspective view of the central member of FIG. 17.
Figure 19:
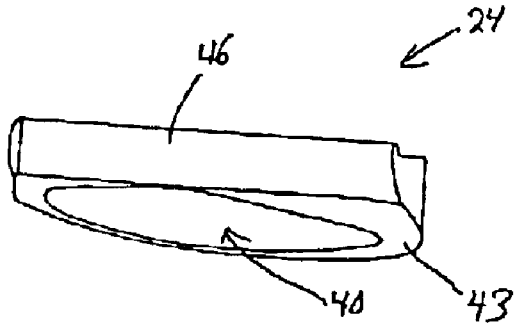
FIG. 19 is an isolated top view of the central member of FIG. 17.
Figure 20:
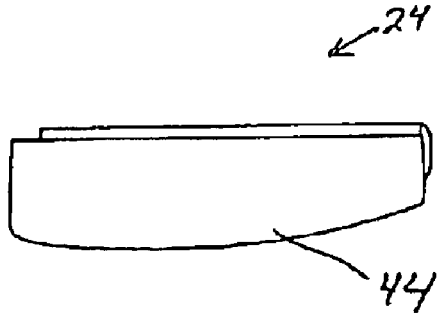
FIG. 20 is an isolated bottom view of the central member of FIG. 17.
Figure 21:
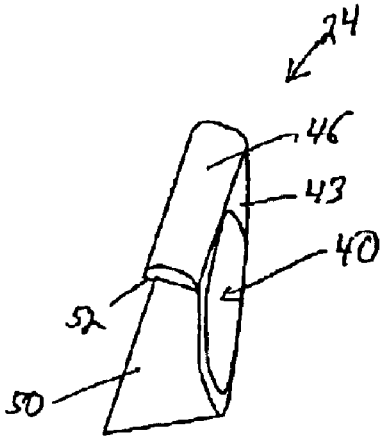
FIG. 21 is an isolated view of the central member of FIG. 17.

The sole wall 28 preferably has a cambered exterior surface, which contacts the ground during a golf swing. As shown in FIG. 8, the sole wall 28 has a width, Ws, that preferably ranges from 0.60 inch to 1.50 inches, and is most preferably 0.87 inch. The sole wall 28 also has a length, Ls, from a toe end to the beginning of the bore 36, which preferably ranges from 2.5 inches to 3.5 inches, and is most preferably 3.0 inches.

Figure 5:
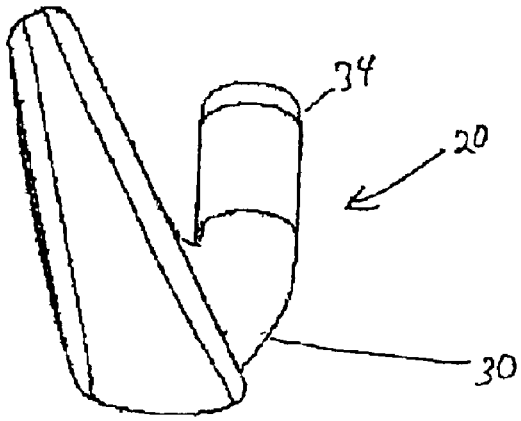
FIG. 5 is a toe side view of the iron club head of FIG. 1.

As shown in FIG. 5, the toe wall 30 preferably has a length, Lt, which preferably ranges from 1.5 inches to 2.5 inches, and is most preferably 2.0 inches. The toe wall 30 preferably has a width that tapers from a lower end to an upper end of the toe wall 30.

Figure 6:
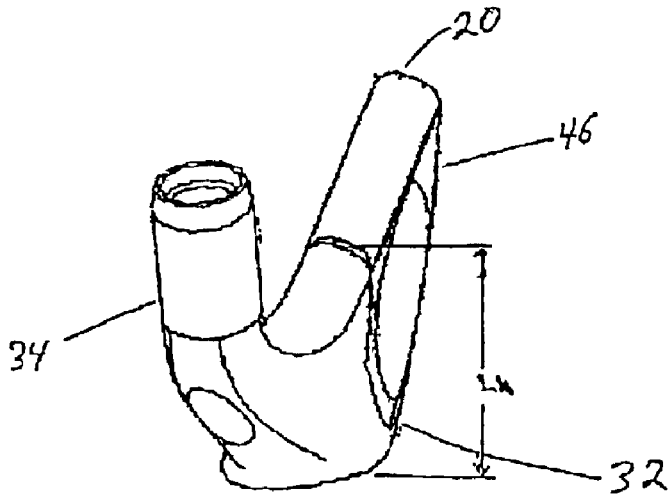
FIG. 6 is a heel side view of the iron club head of FIG. 1.
Figure 7:
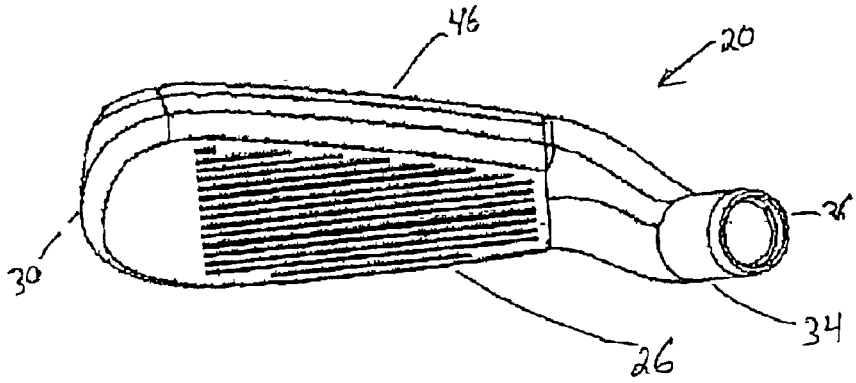
FIG. 7 is a top plan view of the iron club head of FIG. 1.

As shown in FIG. 6, the heel wall 32 preferably has a length, Lh, which preferably ranges from 0.5 inch to 1.5 inches, and is most preferably 1.22 inches. The heel wall 32 preferably has a width that tapers from a lower end to an upper end of the heel wall 32.

In general, the periphery member 22 provides the club head 20 with a greater moment of inertia due to its relatively large mass at the periphery of the club head 20. Further, mass attributable to the sole wall 28 lowers the center of gravity of the club head 20 to promote a higher trajectory during ball striking. The periphery member 22 is preferably 15% to 40% of the volume of the club head 20 and preferably 50% to 85% of the mass of the club head 20.

The central member 24 is composed of a non-metal material. Preferred materials include bulk molding compounds, sheet molding compounds, thermosetting materials and thermoplastic materials. A preferred bulk molding compound is a resinous material with reinforcement fibers. Such resins include polyesters, vinyl esters and epoxy. Such fibers include carbon fibers, fiberglass, aramid or combinations. Such commercially available bulk molding compounds include MS-4A carbon fiber and epoxy molding system from YLA, Inc., of Benicia Calif., LYTEX 4181 and LYTEX 4149 carbon fiber epoxy molding compounds from Quantum Composites of Bay City Mich., ENDURON compound from Cytec Fiberite, and other similar bulk molding compounds. A preferred sheet molding compound is similar to the bulk molding compounds, however, in a sheet form. A preferred thermoplastic material includes injection moldable materials integrated with fibers such as disclosed above. These thermoplastic materials include polyesters, polyethylenes, polyamides, polypropylenes, polyurethanes, and the like.

The central member 24 is primarily a support for the face plate 26, and thus the central member should be able to withstand impact forces without failure. The central member 24 also reduces vibrations of the club head 20 during ball striking. The central member 24 is preferably 10% to 50% of the volume of the club head 20 and preferably 5% to 30% of the mass of the club head 20.

The central member 24 preferably has a body portion 38, a recess 40, a forward surface 42, a rear surface 43, a sole surface 44, a top surface 46, a toe surface 48, a heel surface 50 and a flange 52. The forward surface 42 is preferably at an angle approximate that of the club head 20. Thus, if the club head 20 is a 5-iron, then the forward surface preferably has an angle of approximately 27 degrees. The body portion 38 preferably tapers upward from the sole surface 44.

The central member 24 is disposed on an interior surface of the sole wall 28 of the periphery member 22. The toe surface 48 of the central member 24 preferably engages the interior surface of the toe wall 30 of the periphery member 22. The heel surface 50 of the central member 24 preferably engages the heel wall 32 of the periphery member 22. The top surface 46 preferably creates the top line of the club head 20. The flange 52 extends from the top surface 46 outward over the forward surface 42 thereby creating a top cover for securing the face plate 26. The face plate 26 is also secured within a ledge 60 of the periphery member 22.

The face plate 26 is preferably composed of a light-weight material. Such materials include titanium materials, stainless steel, amorphous metals and the like. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The face plate 26 is preferably manufactured through casting, forging, forming, machining, powdered metal forming, metal-injection-molding, electro-chemical milling, and the like.

The face plate 26 has an interior surface 56 which preferably engages the forward surface 42 of the central member 24, and an exterior surface 54 which preferably has scorelines (not shown) thereon. The face plate preferably has a thickness that ranges from 0.04 inch to 0.250 inch, more preferably from 0.06 inch to 0.130 inch and most preferably 0.075 inch.

The club head 20 preferably has a total volume that ranges from 38.0 $cm^3$ to 55.0 $cm^3$, more preferably from 40.0 $cm^3$ to 50.0 $cm^3$, and most preferably 43.3 $cm^3$. The club head 20 preferably has a mass that ranges from 240 grams to 270 grams, more preferably from 245 grams to 260 grams, and most preferably 253 grams.

The periphery member 22 preferably has a total volume that ranges from 10.0 $cm^3$ to 32.0 $cm^3$, more preferably from 15.0 $cm^3$ to 25.0 $cm^3$, and most preferably 20.1 $cm^3$. The periphery member 22 preferably has a mass that ranges from 150 grams to 240 grams, more preferably from 180 grams to 215 grams, and most preferably 201 grams.

The central member 24 preferably has a total volume that ranges from 7.0 $cm^3$ to 35.0 $cm^3$, more preferably from 15.0 $cm^3$ to 25.0 $cm^3$, and most preferably 18.0 $cm^3$. The central member 24 preferably has a mass that ranges from 9 grams to 70 grams, more preferably from 20 grams to 40 grams, and most preferably 28 grams.

The face plate 26 preferably has a total volume that ranges from 4.0 $cm^3$ to 8.0 $cm^3$, more preferably from 4.5 $cm^3$ to 6.0 $cm^3$, and most preferably 5.3 $cm^3$. The face plate 26 preferably has a mass that ranges from 15 grams to 50 grams, more preferably from 20 grams to 30 grams, and most preferably 24 grams.

FIGS. 9–12 illustrate the axes of inertia through the center of gravity of the golf club head. The axes of inertia are designated X, Y and Z. The X axis extends from rear of the golf club head 20 through the center of gravity, CG, and to the face plate 26. The Y axis extends from the heel end 75 of the golf club head 20 through the center of gravity, CG, and to the toe end 70 of the golf club head 20. The Z axis extends from the sole wall through the center of gravity, CG, and to the top line 80.

As defined in *Golf Club Design, Fitting, Alteration & Repair*, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 preferably ranges from 2200 g-$cm^2$ to 3000 g-$cm^2$, more preferably from 2400 g-$^2$ to 2700 g-$cm^2$, and most preferably from 2450 g-$cm^2$ to 2550 g-$cm^2$. The moment of inertia, Iyy, about the Y axis for the golf club head 20 preferably ranges from 400 g-$cm^2$ to 700 g-$cm^2$, more preferably from 450 g-$cm^2$ to 600 g-$cm^2$, and most preferably from 500 g-$cm^2$ to 550 g-$cm^2$. The moment of inertia, Ixx, about the X axis for the golf club head 20 preferably ranges from 2450 g-$cm^2$ to 3200 g-$cm^2$, more preferably from 2500 g-$cm^2$ to 2900 g-$cm^2$, and most preferably from 2650 g-$cm^2$ to 2800 g-$cm^2$.

For comparison, the new BIG BERTHA® 15-iron from Callaway Golf Company has a moment of inertia, Izz, of 2158 g-$cm^2$, a moment of inertia, Iyy, of 585 g-$cm^2$, and a moment of inertia, Ixx, of 2407 g-$cm^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An iron golf club head comprising:

a periphery member composed of a metal material, the periphery member having a sole wall, a toe wall extending upward from the sole wall at a first end of the sole wall, a hosel extending upward from the sole wall at a second end of the sole wall, and a heel wall extending upward from the sole wall, the sole wall having a width, Ws, ranging from 0.060 inch to 1.50 inches;

a central member composed of a non-metal material, the central member having a body portion with a forward surface, a sole surface, a top surface, a toe surface, a heel surface and a flange extending from the top surface at an intersection of the top surface and the forward surface, the central member having a rear cavity defined by the body portion; and a face plate composed of a metal material, the face plate disposed over the forward surface of the central member, a top line of the face plate in contact with the flange of the central member.

2. The iron golf club head according to claim 1 wherein the face plate is composed of a titanium alloy material and has a thickness ranging from 0.050 inch to 0.250 inch.

3. The iron golf club head according to claim 1 wherein the central member is composed of a bulk molding compound.

4. The iron golf club head according to claim 1 wherein the periphery member is composed of an iron-nickel-tungsten alloy having a density of 8 g/$cm^3$ to 11 g/$cm^3$.

5. The iron golf club head according to claim 1 wherein the club head has a moment of inertia Ixx through the center of gravity of at least 2600 g-cm$^2$.

6. The iron golf club head according to claim 1 wherein an upper end of the hosel is located below the top line of the face plate when the golf club head is in the address position.

7. The iron golf club head according to claim 1 wherein the central member has a volume percentage of the golf club head ranging from 10% to 50%, and a mass percentage of the golf club head ranging from 5% to 30%.

8. The iron golf club head according to claim 1 wherein the periphery member has a volume percentage of the golf club head ranging from 15% to 40%, and a mass percentage of the golf club head ranging from 50% to 85%.

9. The iron golf club head according to claim 1 wherein the club head has a moment of inertia Izz through the center of gravity of at least 2600 g-cm$^2$.

10. An iron golf club head comprising:

a periphery member composed of an iron-nickel-tungsten alloy, the periphery member having a sole wall, a toe wall extending upward from the sole wall at a first end of the sole wall, a hosel extending upward from the sole wall at a second end of the sole wall, and a heel wall extending upward from the sole wall, the periphery member having a volume percentage of the golf club head ranging from 15% to 40%, and a mass percentage of the golf club head ranging from 50% to 85%;

a central member composed of an epoxy resin with non-continuous carbon fibers, the central member having a body portion with a forward surface, a sole surface, a top surface, a toe surface, a heel surface and a flange extending from the top surface at an intersection of the top surface and the forward surface, the central member having a rear cavity defined by the body portion, the central member having a volume percentage of the golf club head ranging from 10% to 50%, and a mass percentage of the golf club head ranging from 5% to 30%; and a face plate composed of a titanium alloy, the face plate disposed over the forward surface of the central member, a top line of the face plate in contact with the flange of the central member.

11. An iron golf club head comprising:

a periphery member composed of a metal material, the periphery member having a sole wall, a toe wall extending upward from the sole wall at a first end of the sole wall, a hosel extending upward from the sole wall at a second end of the sole wall, and a heel wall extending upward from the sole wall, the sole wall having a width, Ws, ranging from 0.060 inch to 1.50 inches;

a central member composed of a non-metal material, the central member having a body portion with a forward surface, a sole surface, a top surface, a toe surface, a heel surface and a flange extending from the top surface at an intersection of the top surface and the forward surface, the central member having a rear cavity defined by the body portion; and a face plate composed of a metal material, the face plate disposed over the forward surface of the central member, an upper perimeter of the face plate in contact with the flange of the central member;

wherein the club head has a moment of inertia Izz through the center of gravity of at least 2600 g-cm$^2$ and a moment of inertia Ixx through the center of gravity of at least 2600 g-cm$^2$.

* * * * *